US007789440B2

(12) United States Patent
Graute et al.

(10) Patent No.: US 7,789,440 B2
(45) Date of Patent: Sep. 7, 2010

(54) MOTOR VEHICLE DOOR LOCK

(75) Inventors: Ludger Graute, Essen (DE); Ömer Inan, Essen (DE)

(73) Assignee: Kiekert AG, Heiligenhaus (DE)

( * ) Notice: Subject to any disclaimer, the term of this patent is extended or adjusted under 35 U.S.C. 154(b) by 869 days.

(21) Appl. No.: 10/555,203

(22) PCT Filed: Apr. 30, 2004

(86) PCT No.: PCT/DE2004/000914

§ 371 (c)(1),
(2), (4) Date: Nov. 1, 2005

(87) PCT Pub. No.: WO2004/101929

PCT Pub. Date: Nov. 25, 2004

(65) Prior Publication Data

US 2006/0202487 A1 Sep. 14, 2006
US 2008/0012353 A9 Jan. 17, 2008

(30) Foreign Application Priority Data

May 8, 2003 (DE) ..... 103 20 443

(51) Int. Cl.
*E05C 3/06* (2006.01)
*E05C 3/16* (2006.01)

(52) U.S. Cl. ..... 292/216; 292/341.12; 292/DIG. 56; 292/DIG. 57; 292/DIG. 73

(58) Field of Classification Search ..... 292/216, 292/341.12, DIG. 56, DIG. 57, DIG. 73
See application file for complete search history.

(56) References Cited

U.S. PATENT DOCUMENTS

| | | | | |
|---|---|---|---|---|
| 4,756,564 | A | 7/1988 | Ikeda | |
| 4,783,103 | A | 11/1988 | Schlegel | |
| 4,854,617 | A * | 8/1989 | Hayakawa et al. | 292/216 |
| 5,035,453 | A * | 7/1991 | Fukumoto et al. | 292/336.3 |
| 5,288,115 | A * | 2/1994 | Inoue et al. | 292/201 |
| 5,348,357 | A * | 9/1994 | Konchan et al. | 292/216 |
| 5,642,636 | A * | 7/1997 | Mitsui | 70/237 |
| 6,280,592 | B1 * | 8/2001 | Mastrofrancesco et al. | 204/485 |
| 6,749,234 | B2 * | 6/2004 | Bruce | 292/216 |
| 6,789,825 | B2 * | 9/2004 | Kalargeros et al. | 292/216 |
| 7,188,872 | B2 * | 3/2007 | Kalargeros et al. | 292/216 |
| 7,195,292 | B2 * | 3/2007 | Ketelsen et al. | 292/216 |

FOREIGN PATENT DOCUMENTS

| | | | |
|---|---|---|---|
| DE | 23 20 351 | | 10/1974 |
| DE | 102 16 313 | A1 | 10/2003 |
| EP | 0 628 682 | A1 | 12/1994 |
| IT | EP 995870 | * | 10/1999 |

* cited by examiner

*Primary Examiner*—Carlos Lugo
(74) *Attorney, Agent, or Firm*—Matthias Scholl, PC; Matthias Scholl

(57) ABSTRACT

Vehicle door latch, in which the catch comprises a casing made of sound-proofing material, the casing containing a buffer pocket, situated behind the primary position in clockwise direction and the buffer pocket being stretched around up to the area of the primary position, forming an overtravel stop cooperating with the pawl.

31 Claims, 4 Drawing Sheets

MOTOR VEHICLE DOOR LOCK

CROSS-REFERENCE TO RELATED APPLICATIONS

This is a National Stage Application of International Patent Application No. PCT/DE 2004/000914, with an international filing date of Apr. 30, 2004, which is based on German Patent Application No. 103 20 443.1, filed May 8, 2003. The contents of both of these specifications are incorporated herein by reference.

BACKGROUND OF THE INVENTION

1. Field of the Invention

The invention refers to a vehicle door latch with at least one locking mechanism, comprising mainly a catch with a primary position and, where applicable, a first position for an engaging pawl and containing an inlet opening as well as a catch bolt cooperating with the catch.

2. Description of Related Art

In the reference system of the vehicle door latch, the catch bolt moves into the inlet opening. Generally, the catch bolt is located on the vehicle body, opposite to which the vehicle door latch is moved with its inlet opening.

With vehicle door latches of this kind, constant efforts are made to improve soundproofing when, on one hand, the catch bolt moves into the inlet opening and is held by the catch in its primary position, whilst, on the other hand, it also has to be ensured that the pawl cooperating with the catch does not leave the primary position, if the catch carries out an overtravel as part of its closing movement. Such an overtravel is necessary because of the tolerances required between the catch and pawl for the closing and opening movement.

BRIEF DESCRIPTION OF THE DRAWINGS

Below, the invention is explained in more detail with reference to only one embodiment illustrated by the following drawings.

BRIEF SUMMARY OF THE INVENTION

Figure 1:
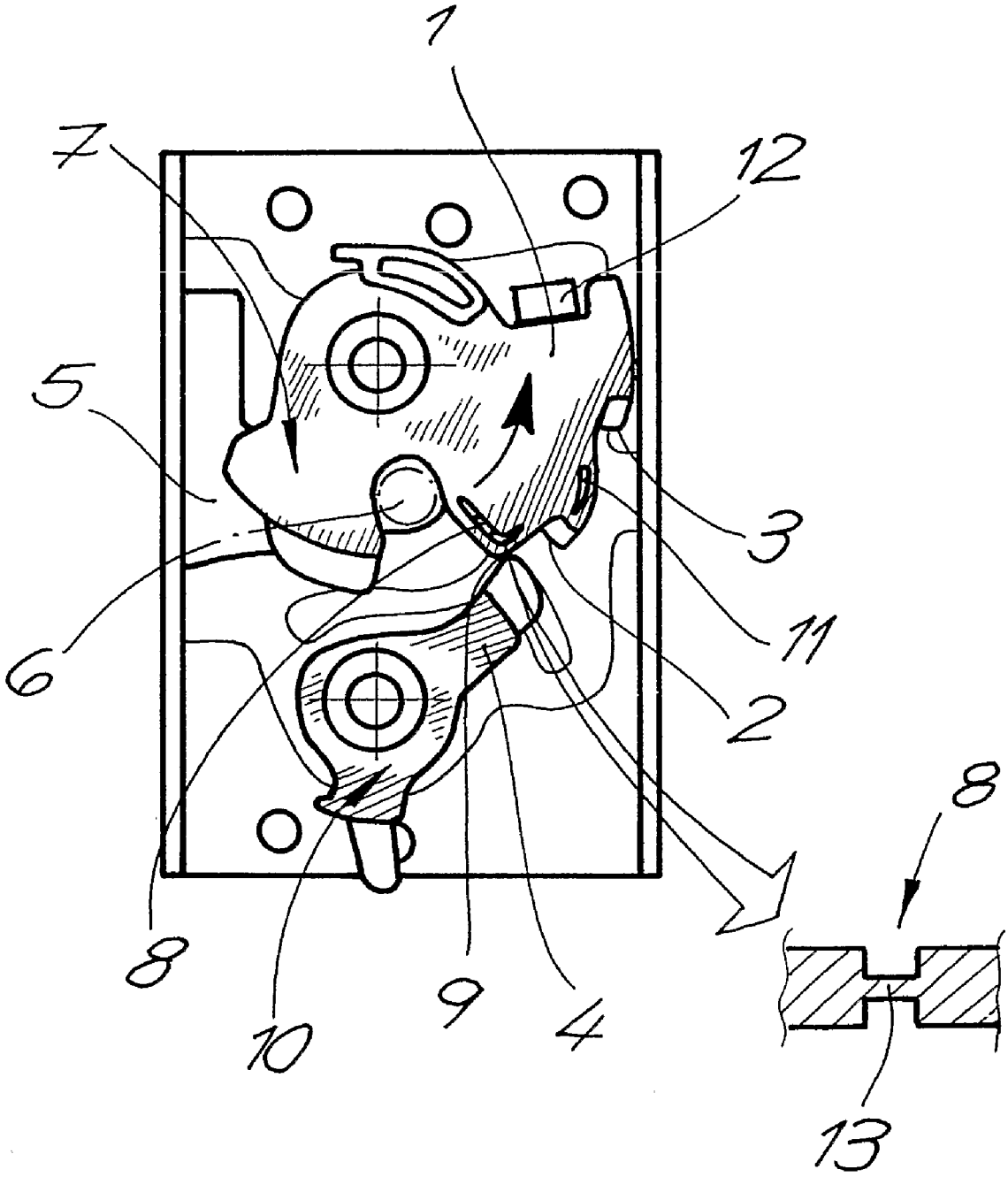
FIG. 1 represents a plan view of a vehicle door latch according to the invention with a back plate, catch, pawl and an indicated catch.
Figure 2:
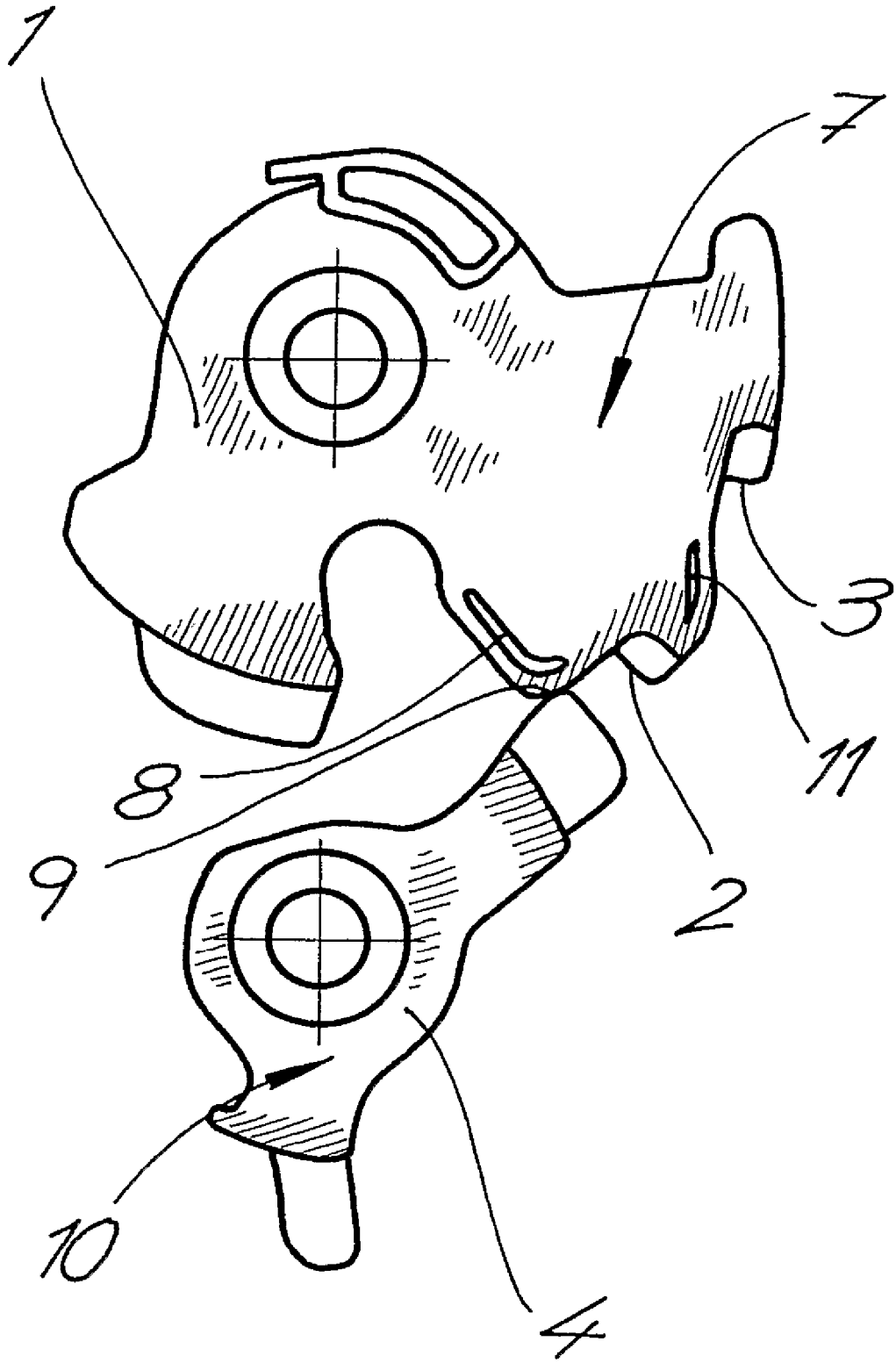
FIG. 2 represents an enlarged section of the object shown in FIG. 1, in which the pawl lies against the overtravel stop on the catch.
Figure 3:
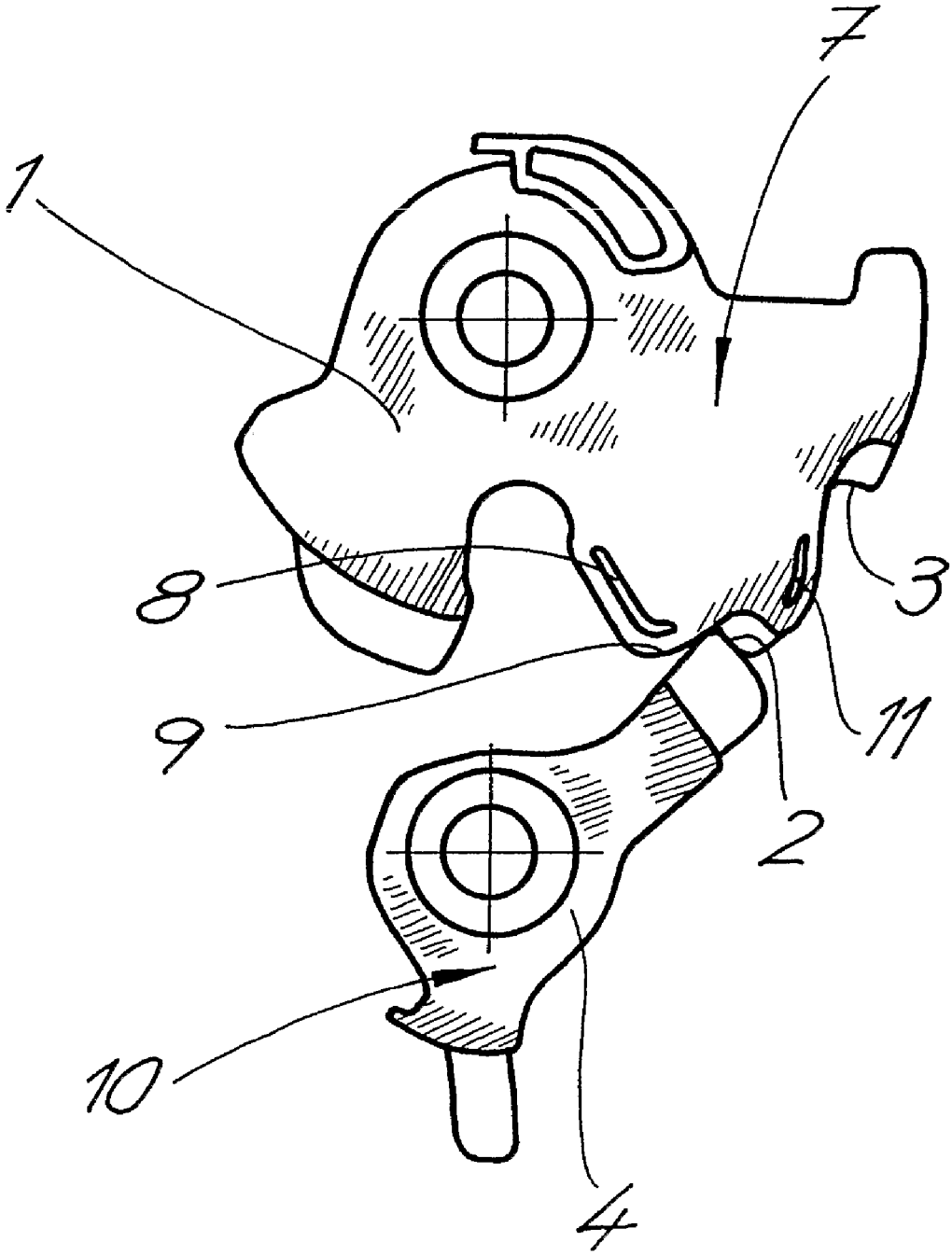
FIG. 3 represents the object shown in FIG. 2, with the pawl in primary position.
Figure 4:
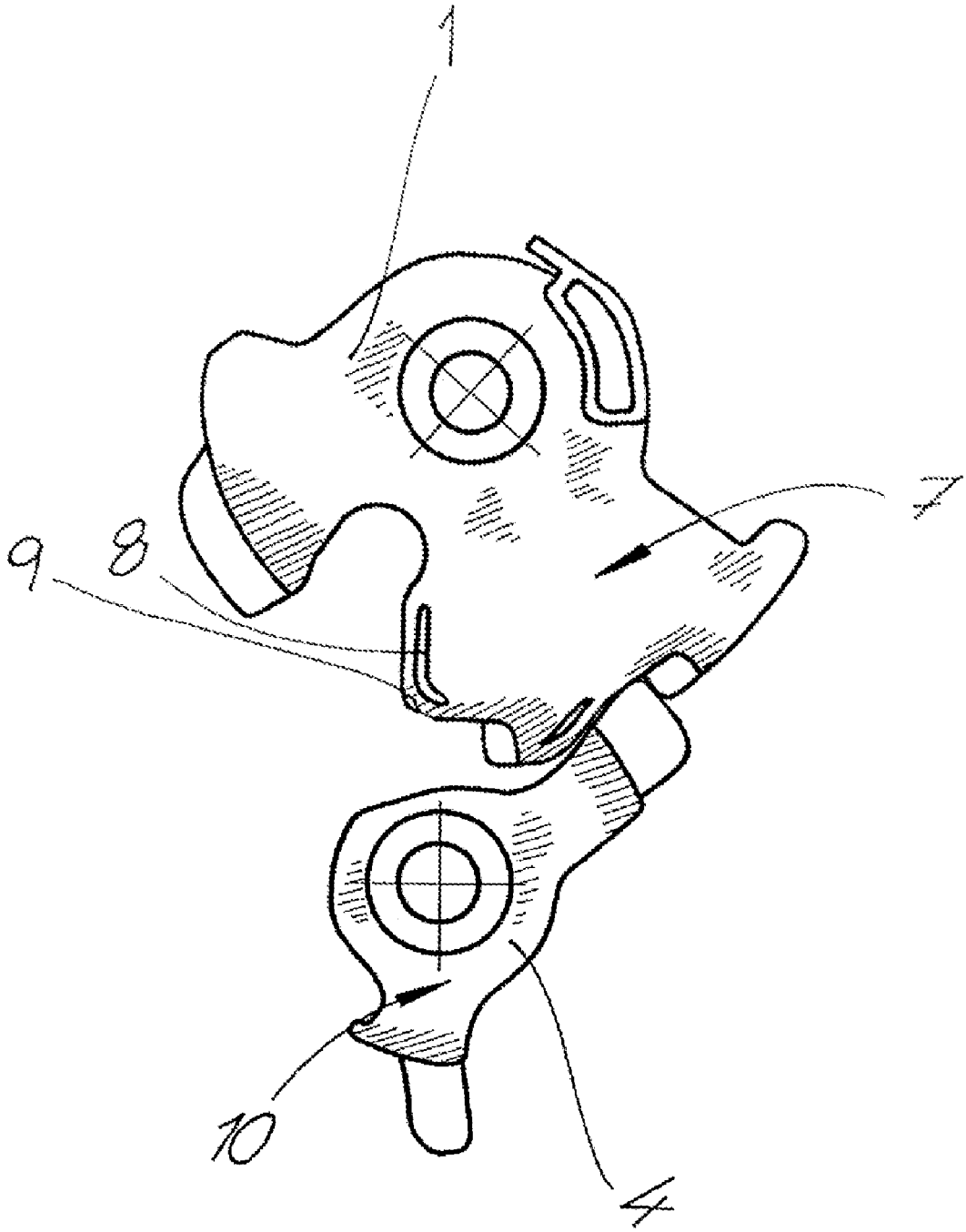

The invention described herein provides a vehicle door latch with at least one locking mechanism (1, 4), comprising mainly a catch (1) with a primary position (2) and, where applicable, a first position (3) for an engaging pawl (4) and an inlet opening (5) as well as a catch bolt (6) cooperating with the catch (1) and in which at least the catch (1) contains a casing (7) made of soundproofing material and the casing (7) contains a buffer pocket (8) situated behind the primary position (2) in clockwise direction, said buffer pocket being stretched around up to the area of the primary position (2), forming an overtravel stop (9) for cooperation with the pawl 4.

In certain embodiments of the invention described herein, the pawl (4) is at least partially encased by soundproofing material (10).

In certain embodiments of the invention described herein, the pawl (4) contains a surface coating of anti-seizing varnish or anti-corrosion agent.

In certain embodiments of the invention described herein, soundproofing material (10) is a plastic, such as polyurethane.

In certain embodiments of the invention described herein, the casing (7) of the catch (1) contains a buffer pocket (11) between primary position (2) and first position (3).

In certain embodiments of the invention described herein, the transmission ratio of catch (1)/pawl (4) is reduced, i.e. to 2:1.

DETAILED DESCRIPTION OF THE INVENTION

The invention is based on the technical problem of creating a vehicle door latch of the embodiment described above, that is characterized by noise reduction and a reliable function during the cooperation of the catch, pawl and catch bolt.

In order to solve this technical problem, the invention provides a vehicle door latch with at least one locking mechanism, comprising mainly a catch with a primary position and, where applicable, a first position for an engaging pawl and a catch bolt moving into an inlet opening and cooperating with the catch, with at least the catch containing a casing of soundproofing material and the casing containing a buffer pocket situated behind the primary position in clockwise direction, said buffer pocket being stretched around up to the area of the primary position, forming an overtravel stop for the pawl.

These measures of the invention ensure, in the first instance, that the catch bolt moving into the inlet opening during the closing of a respective vehicle door in the reference system of the vehicle door latch is buffered by the catch during gripping as a result of the buffer pocket integrated in the casing of the catch. Consequently, not only the casing consisting of soundproofing material but, in particular, also the buffer pocket ensures a quieter closing operation as well as a considerable noise reduction when the vehicle door is closed. It is also ensured that the reliable function of the vehicle door latch of the invention is guaranteed even if the catch carries out an overtravel as part of the closing operation, as the overtravel stop for the pawl ensures that the pawl remains in the primary position area of the catch.

The catch carries out a limited overtravel, restricted by a stop, e.g. in the back plate or latch housing, until the overtravel stop comes into contact with the pawl. Due to the cooperation of the overtravel stop on the catch with the pawl, the pawl cannot leave the primary position area and lies flush against the primary position of the spring-loaded catch upon completion of the closing operation.

Also, in case of an overtravel of the catch, a noise reduction between the catch and pawl is achieved, as the overtravel stop of the pawl on the catch is formed by the buffer pocket stretched around into this area, which also guarantees a resilient interception of not only the catch bolt but also of the pawl during overtravel, as part of an overtravel compensation.

Other characteristics offered by the invention are detailed below. The pawl can, for instance, also be only partially encased by a soundproofing material to further enhance soundproofing. This soundproofing material can be a thermoplastic plastic, such as polyurethane. The casing of the catch can also contain a buffer pocket between the primary position and the first position, to achieve further soundproofing, when the pawl is moved from the first position into the primary position. Finally, in a vehicle door latch according to the invention, there is also the possibility of reducing the transmission ration of the catch/pawl to, for example 2:1. This achieves, on one hand, a more compact design and optimizes, on the other hand, kinematics relationships.

The figures show a vehicle door latch with at least one locking mechanism, comprising mainly a catch 1 with a primary position 2 and first position 3 for an engaging pawl 4 and a catch bolt 6 moving into an inlet opening 5 and cooperating with catch 1, said catch bolt being only indicated. As soon as the pawl 4 is lifted, the spring-loaded catch 1 turns clockwise and consequently to the open position. At the same time, the catch bolt 6 is released, allowing the respective vehicle door—not shown—to be opened. The lifting of the pawl 4 can be by purely mechanical means by a lever gear—not shown—or with the aid of a motor and, in particular, an electrical motor. During the closing operation, the catch 1 turns anti-clockwise according to the direction of the arrow in FIG. 1 and is able to carry out an overtravel. It must, however, be ensured that the assigned pawl 4 does not leave the primary position area and then engages easily in the primary position 2.

Catch 1 contains a casing 7 made of soundproofing material. This casing 7 contains a buffer pocket 8 situated behind the primary position 2 in clockwise direction, said buffer pocket being stretched around up to the area of the primary position 2, forming an overtravel stop 9 for the pawl 4. As part of the closing movement and an overtravel, catch 1 rests with its overtravel stop 9 against the pawl 4. This ensures that the pawl 4 does not leave the primary position and then easily engages in primary position 2, especially as the catch 1 is spring-loaded in clockwise direction.—Also the pawl 4 itself can, at least partially, be encased by soundproofing material 10. The pawl 4 can, however, also contain a surface coating of anti-seizing varnish or anti-corrosion agent. Where the pawl is partially encased, this surface coating can be limited to the areas not encased.

The soundproofing material 10 is a thermoplastic plastic, e.g. polyurethane. The casing 7 of catch 1 can also contain a buffer pocket 11 for pawl 4 between primary position 2 and first position 3. This buffer pocket 11 is of a predominantly straight design, whilst the buffer pocket 8, forming the overtravel stop 9, is curved towards the primary position 2. Both buffer pockets 8, 11 are designed as slotted pockets.

The transmission ratio of the catch 1/pawl 4 is reduced to 2:1.—FIG. 1 also shows a stop 12 in the back plate or latch housing, producing the restriction of the overtravel of catch 1, described above. The enlarged view of FIG. 1 shows another modification, in which the buffer pocket 8 can contain reinforcement ribs 13, in order to be able to act easily and permanently as overtravel stop 9.

What is claimed is:

1. A vehicle door latch with at least one locking mechanism (1, 4) comprising a pawl (4);

a catch (1) having a primary position (2) for engaging said pawl (4) when the catch is in a closed position, and a first position (3) for engaging said pawl (4) when the catch is in an open position; and an inlet opening (5) for receiving a catch bolt (6); wherein said catch (1) comprises a casing (7), said casing (7) being made of a soundproofing material and having a first buffer pocket (8), said first buffer pocket (8) being disposed next to said primary position (2) in the clockwise direction;

said first buffer pocket (8) forms an overtravel stop (9) for said pawl (4);

said pawl (4) is at least partially encased by a soundproofing material; and said pawl (4) abuts said overtravel stop (9) when said catch is rotated counterclockwise during closing of the latch up to a mechanical rotational limit of said catch (1).

2. The vehicle door latch of claim 1, wherein said pawl (4) comprises further a surface coating of anti-seizing varnish or anti-corrosion agent.

3. The vehicle door latch of claim1, wherein said casing (7) further comprises a second buffer pocket (11), said second buffer pocket (11) being disposed between said primary position (2) and said first position (3), and said primary position (2) being disposed between said first buffer pocket (8) and said second buffer pocket (11).

4. The vehicle door latch of claim 3, wherein said second buffer pocket is of a straight design.

5. The vehicle door latch of claim 1, wherein a transmission ratio between said catch (1) and said pawl (4) is greater than 1.

6. The vehicle door latch of claim 1, wherein said first buffer pocket (8) buffers said catch bolt (6) during gripping.

7. The vehicle door latch of claim 1, wherein said first buffer pocket (8) reduces noise associated with closing of the vehicle door latch.

8. The vehicle door latch of claim 1, wherein said first buffer pocket (8) forms an overtravel stop (9) for said pawl (4), said overtravel stop (9) operating so as to prevent said pawl (4) from leaving from said primary position (2) upon completion of a closing operation of the vehicle door latch.

9. The vehicle door latch of claim 1, wherein said first buffer pocket (8) forms an overtravel stop (9) for said pawl (4), said overtravel stop (9) providing a resilient operation of said catch bolt (6) and said pawl (4).

10. The vehicle door latch of claim 1, wherein said first buffer pocket (8) comprises further reinforcement ribs (13), said reinforcement ribs (13) acting as overtravel stop (9).

11. The vehicle door latch of claim 1, wherein said first buffer pocket is of an L-shaped design.

12. A vehicle door latch with at least one locking mechanism (1, 4) comprising a pawl (4);

a catch (1) having a primary position (2) for engaging said pawl (4) when the catch is in a closed position; and an inlet opening (5) for receiving a catch bolt (6); wherein said catch (1) comprises a casing (7), said casing (7) being made of a soundproofing material and having a first buffer pocket (8), said first buffer pocket (8) being disposed next to said primary position (2) in the clockwise direction; said first buffer pocket (8) being curved towards the primary position (2)-and having an L-shape;

said first buffer pocket (8) forms an overtravel stop (9) for said pawl (4); and said pawl (4) abuts said overtravel stop (9) when said catch is rotated counterclockwise during closing of the latch up to a mechanical rotational limit of said catch (1).

13. The vehicle door latch of claim 12, wherein said pawl (4) is at least partially encased by a soundproofing material.

14. The vehicle door latch of claim 13, wherein said casing (7) further comprises a second buffer pocket (11), said second buffer pocket (11) being disposed between said primary position (2) and said first position (3), and said primary position (2) being disposed between said first buffer pocket (8) and said second buffer pocket (11).

15. The vehicle door latch of claim 14, wherein said second buffer pocket is of a straight design.

16. The vehicle door latch of claim 15, wherein said second buffer pocket has a constant cross-sectional area.

17. The vehicle door latch of claim 14, wherein in its primary closed position, the pawl abuts an area of said catch between said first pocket and said second pocket.

18. The vehicle door latch of claim 12, wherein said pawl (4) comprises further a surface coating of anti-seizing varnish or anti-corrosion agent.

19. The vehicle door latch of claim 12, wherein said casing (7) further comprises a second buffer pocket (11), said second buffer pocket (11) being disposed between said primary position (2) and said first position (3), and said primary position (2) being disposed between said first buffer pocket (8) and said second buffer pocket (11).

20. The vehicle door latch of claim 19, wherein said second buffer pocket is of a straight design.

21. The vehicle door latch of claim 20, wherein said second buffer pocket has a constant cross-sectional area.

22. The vehicle door latch of claim 19, wherein in its primary closed position, the pawl abuts an area of said catch between said first pocket and said second pocket.

23. The vehicle door latch of claim 12, wherein a transmission ratio between said catch (1) and said pawl (4) is greater than 1.

24. The vehicle door latch of claim 12, wherein said first buffer pocket (8) buffers said catch bolt (6) during gripping.

25. The vehicle door latch of claim 12, wherein said first buffer pocket (8) reduces noise associated with closing of the vehicle door latch.

26. The vehicle door latch of claim 12, wherein said first buffer pocket (8) forms an overtravel stop (9) for said pawl (4), said overtravel stop (9) operating so as to prevent said pawl (4) from leaving from said primary position (2) upon completion of a closing operation of the vehicle door latch.

27. The vehicle door latch of claim 12, wherein said first buffer pocket (8) forms an overtravel stop (9) for said pawl (4), said overtravel stop (9) providing a resilient operation of said catch bolt (6) and said pawl (4).

28. The vehicle door latch of claim 12, wherein said first buffer pocket (8) comprises further reinforcement ribs (13), said reinforcement ribs (13) acting as overtravel stop (9).

29. The vehicle door latch of claim 12, wherein said first buffer pocket is of an L-shaped design.

30. A vehicle door latch with at least one locking mechanism (1, 4) comprising a pawl (4);

a catch (1) having a primary position (2) for engaging said pawl (4) when the catch is in a closed position, and a first position (3) for engaging said pawl (4) when the catch is in an open position; and an inlet opening (5) for receiving a catch bolt (6); wherein said catch (1) comprises a casing (7), said casing (7) being made of a soundproofing material and having a first buffer pocket (8), said first buffer pocket (8) being disposed next to said primary position (2) in the clockwise direction;

said first buffer pocket (8) forms an overtravel stop (9) for said pawl (4);

said pawl (4) is at least partially encased by a soundproofing material; and said overtravel stop (9) cushions said pawl (4) when said catch is in an overtravel position.

31. The vehicle door latch of claim 30, wherein said first pocket cushions said pawl in said overtravel position.

* * * * *